US006644957B2

(12) United States Patent
Weiss

(10) Patent No.: US 6,644,957 B2
(45) Date of Patent: Nov. 11, 2003

(54) DAMPER CONTROL DEVICE

(75) Inventor: Cory A. Weiss, Warren, MI (US)

(73) Assignee: Effikal International, Inc., Orion, MI (US)

( * ) Notice: Subject to any disclaimer, the term of this patent is extended or adjusted under 35 U.S.C. 154(b) by 56 days.

(21) Appl. No.: 10/091,717

(22) Filed: Mar. 6, 2002

(65) Prior Publication Data

US 2003/0170578 A1 Sep. 11, 2003

(51) Int. Cl.[7] ..... F23N 3/08

(52) U.S. Cl. ..... 431/20; 431/80; 126/285 B; 236/1 G

(58) Field of Search ..... 431/20, 42, 6, 431/80, 82; 126/285 B; 236/1 G, 1 A

(56) References Cited

U.S. PATENT DOCUMENTS 2,349,443 A 5/1944 McCarty
4,204,833 A 5/1980 Kmetz
4,406,396 A 9/1983 Habegger
4,550,874 A 11/1985 Clouser
4,778,378 A 10/1988 Dolnick
4,846,400 A 7/1989 Crouse
5,393,221 A 2/1995 McNally
6,257,871 B1 7/2001 Weiss

*Primary Examiner*—Henry Bennett
*Assistant Examiner*—James Barrow
(74) *Attorney, Agent, or Firm*—Robert Kelley Roth; Miller, Canfield, Paddock & Stone PLC

(57) ABSTRACT

A device for controlling a damper in an appliance is disclosed comprising a motor having a rotatable shaft extending therefrom which is operatively connected to a plate of the damper, a control circuit which transmits current to the motor to rotate the shaft and in turn rotate the plate to a first position and to a second position, and a dynamic brake operatively connected to the motor, which acts to reduce rotation of the shaft when the circuit supplying current to the motor is opened.

13 Claims, 5 Drawing Sheets

THERMOELECTRIC DEVICE 90
88
66
50
92
94
48
99
MOTOR
62
60
76
74
70
68
86
78
72
38
64
82
84
80

DAMPER CONTROL DEVICE

FIELD OF THE INVENTION

This invention relates to appliances such as water heaters, space heaters and fireplaces and, more particularly, to a device for controlling components commonly found in such appliances, namely, dampers and valves.

BACKGROUND OF THE INVENTION

U.S. Pat. No. 6,257,871 B1 to Weiss et al, incorporated herein by reference discloses a novel and highly useful control device (sometimes referred to as a "millivolt" system) for an appliance (such as a water heater or furnace), typically a gas burning appliance having a pilot light. The control device operates a damper positioned in an exhaust vent. The position of the damper can be controlled to help improve overall appliance efficiency. The appliance advantageously eliminates the need for an external power source (and attendant wiring) to control a vent damper by using thermoelectric devices such as thermopiles at the pilot light as a power source.

Motors used to move the damper in such control devices have specified operating voltages, and these millivolt systems have been found to work well near such specified operating voltages. However, the voltage to the motor is a function of the current supplied by the thermoelectric devices, and that in turn depends on the intensity of the heat applied to the thermoelectric devices (typically burning gas at a pilot light). Thus, when the pilot light is too strong voltages larger than the specified range could be delivered to the motor. The motor is supposed to shut off upon rotation of a cam to depress a switch corresponding to a predetermined condition such as an open or closed position for the damper, but high residual voltages may cause the motor to continue to operate to rotate the damper, a phenomena know as spinning.

One possible solution for the problem of spinning is adoption of voltage regulation circuitry. However, the millivolt system operates at low power levels and no commercially available components are known for use in such circuitry. Another possible approach is to modify the geometry of the cam and/or the cam/switch alignment. However, maintaining proper alignment and geometry may be difficult, especially with repeated cycling, and it may be necessary to increase operating voltage to ensure proper rotation, thereby increasing the possibility of spinning. It would be desirable to increase the acceptable operating voltage of such motors so that the control device can operate under a wider range of conditions (i.e., be less sensitive to in variations in part geometry, location and input voltage), without adding significant additional cost or complexity to the overall control device.

SUMMARY OF THE INVENTION

In accordance with a first aspect, a device for controlling a damper in an appliance comprises a motor having a rotatable shaft extending therefrom which is operatively connected to a plate of the damper, a control circuit which selectively transmits current to the motor to rotate the shaft and in turn rotate the plate to a first position and to a second position, and a dynamic brake operatively connected to the motor which acts to reduce rotation of the shaft when the current is removed from the motor.

From the foregoing disclosure and the following more detailed description of various preferred embodiments it will be apparent to those skilled in the art that the present invention provides a significant advance in the technology and art of damper control devices. Particularly significant in this regard is the potential the invention affords for providing a high quality, low cost, damper control device for furnaces and water heaters. Additional features and advantages of various preferred embodiments will be better understood in view of the detailed description provided below.

Figure 1:
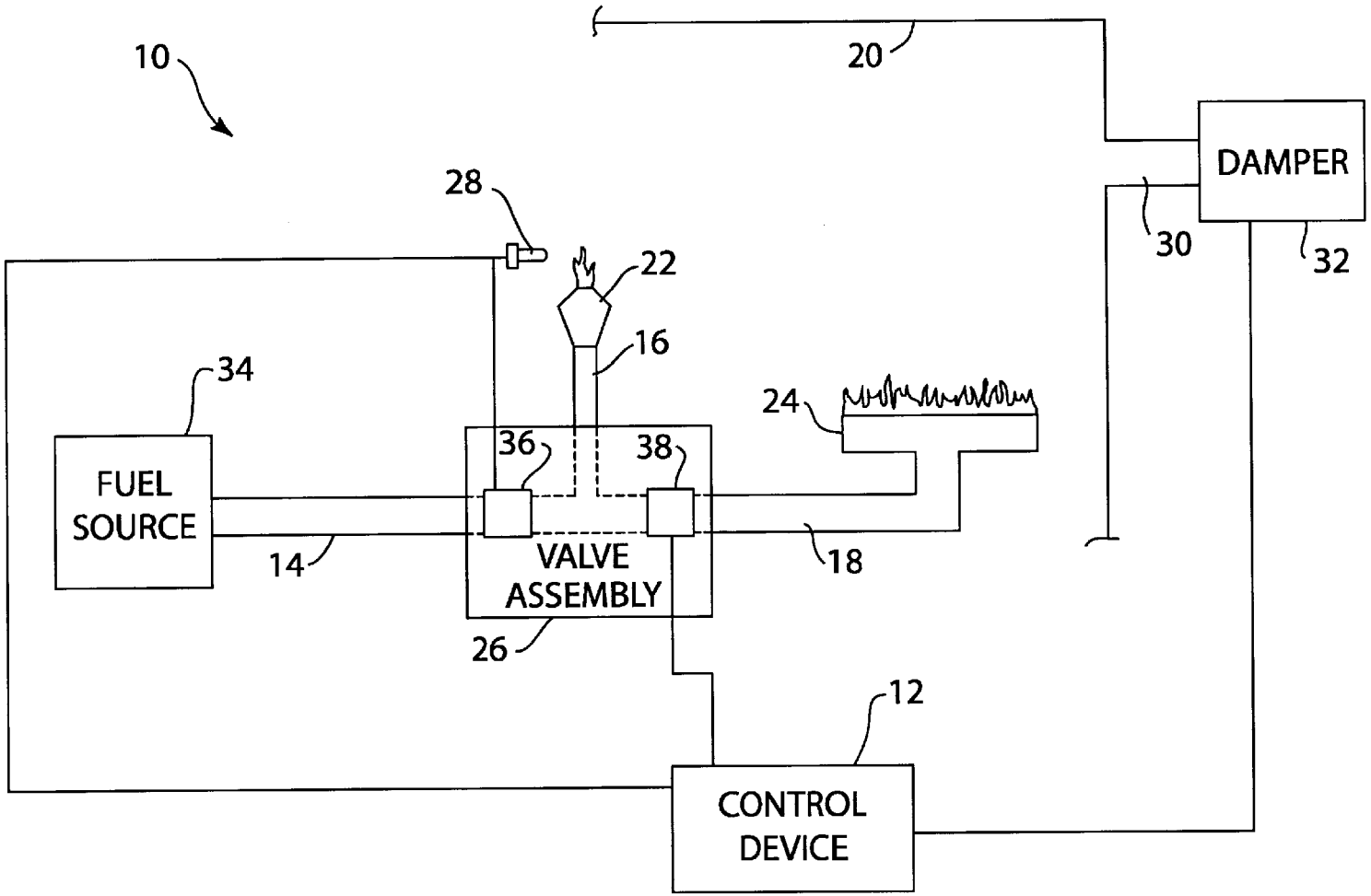
FIG. 1 is schematic view illustrating an appliance incorporating a control device in accordance with a preferred embodiment.

It should be understood that the appended drawings are not necessarily to scale, presenting a somewhat simplified representation of various preferred features illustrative of the basic principles of the invention. The specific design features of the control circuit as disclosed here, including, for example, the specific operating voltage of the motor, will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the control device disclosed here. The following detailed discussion of various alternative and preferred features and embodiments will illustrate the general principles of the invention with reference to a control device for a gas-fired appliance such as a furnace or a water heater. Other embodiments suitable for other applications will be apparent to those skilled in the art given the benefit of this disclosure.

Referring now to the drawings, FIG. 1 illustrate a gas-fired appliance 10 incorporating a control device 12 in accordance with the present invention. Appliance 10 may comprise, for example a water heater, a space heater, fireplace or any other conventional gas-fired appliance. In addition to control device 12, appliance 10 may include several sections of gas pipe 14, 16, 18, a combustion chamber 20, a pilot burner 22, a main burner 24, a valve assembly 26, a thermoelectric device 28, an exhaust vent 30, and a damper 32.

Pipe sections 14, 16,18 are provided to direct fuel gas received from a fuel source 34 to the pilot and main burners 22, 24 within appliance 10. Section 14 is connected at one end to valve assembly 26 and at another end to fuel source 34. Fuel source 34 may be located at a distance remote from appliance 10 and additional sections of gas pipe may be used to connect fuel source 34 to pipe section 14. The fuel gas supplied by fuel source 34 may comprise natural gas, propane, butane or other conventional fuel gases. Section 16 is also connected at one end to valve assembly 26 and at another end to pilot burner 22. Section 18 is also connected at one end to valve assembly 26 and at another end to main burner 24.

Combustion chamber 20 provides a space for burning the fuel gas provided by fuel source 34. Chamber 20 encompasses at least main burner 24. Pilot burner 22 is provided to ignite main burner 24 upon the introduction of fuel gas to main burner 24. Pilot burner 22 preferably comprises a standing pilot burner (i.e., a continuously operating pilot burner). Main burner 24 is provided to generate heat within appliance 10 to increase the temperature of water, air, or another medium depending upon the purpose for which appliance 10 is designed.

Valve assembly 26 is provided to control the passage of fuel gas from fuel source 34 to pilot burner 22 and main burner 24. Valve assembly 26 may comprise, for example, one of the 7000MVR Series of heating controls sold by Robertshaw Controls Company of Long Beach, Calif. Assembly 26 includes a pilot burner valve 36 and a main burner valve 38. Pilot burner valve 36 is disposed between fuel source 34 and pilot burner 22. Main burner valve 38 is disposed between fuel source 34 and main burner 24. As illustrated in FIG. 1, in order for fuel gas to reach main burner 24, the fuel gas must pass through pilot burner valve 36 in addition to main burner valve 38. Accordingly, the closure of pilot burner valve 36 will prevent fuel gas from reaching main burner 24.

Thermoelectric device 28 is provided to detect the presence of the pilot flame and to generate current for use by the electrically actuated components of appliance 10. In particular, device 28 provides power to control device 12 for use in controlling damper 32 and main burner valve 38. The thermoelectric device 28 comprises one or more thermopiles. Thermopiles may comprise, for example, the Model No. Q313 thermopile sold by Honeywell, Inc. of Morristown, N.J. Device 28 is disposed proximate pilot burner 22 and generates current in the presence of a pilot flame. The current generated by device 28 may be used to control pilot burner valve 36. In particular, the current may be used to power a solenoid to maintain valve 36 in an open position. If the pilot flame is extinguished, device 28 will cease generating current and valve 36 will close to prevent a further buildup of unburned gas within appliance 10. The current generated by device 28 is also provided to control device 12 for use in controlling damper 32 and main burner valve 38 as described in greater detail hereinbelow.

Figure 2:
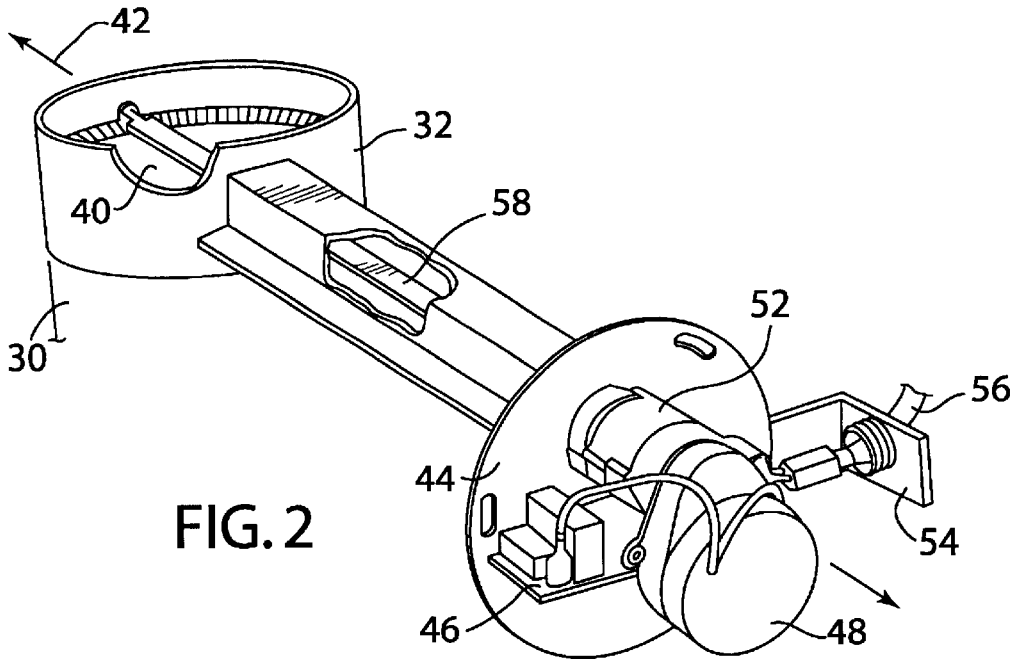
FIG. 2 is a perspective view of several components of the appliance of FIG. 1.

Exhaust vent 30 is provided to evacuate emissions, generated as a result of the combustion process, from the combustion chamber 20 in appliance 10. Vent 30 is coupled at one end to the combustion chamber 20 of appliance 10 and at a second end to a venting area, such as the outdoors, where emissions from the combustion process can be dissipated. A damper 32 is positioned in the exhaust vent. The damper 32 is used to control the evacuation of heat from combustion chamber 20 through vent 30 in order to improve the efficiency of appliance 10. Damper 32 may comprise the Model No. RVGP-KSF damper sold by Effikal International, Inc., assignee of the present invention. Referring to FIG. 2, damper 32 is supported within vent 30 and comprises a plate 40 that is rotatable about an axis 42 extending transversely to the longitudinal axis of vent 30 and to the direction of airflow through vent 30. As plate 40 rotates about axis 42, plate 40 assumes a plurality of angular positions: a closed position (illustrated in FIG. 2) in which damper 32 allows a minimum outflow of air from combustion chamber 20 and an open position in which damper 32 allows a maximum outflow of air from combustion chamber 20. Plate 40 preferably assumes a closed position immediately after main burner 24 is extinguished in order to reduce or eliminate the evacuation of heat through vent 30. Plate 40 preferably assumes an open position immediately prior to ignition of main burner 24 in order to allow the evacuation of emissions generated by the combustion process.

Figure 5:
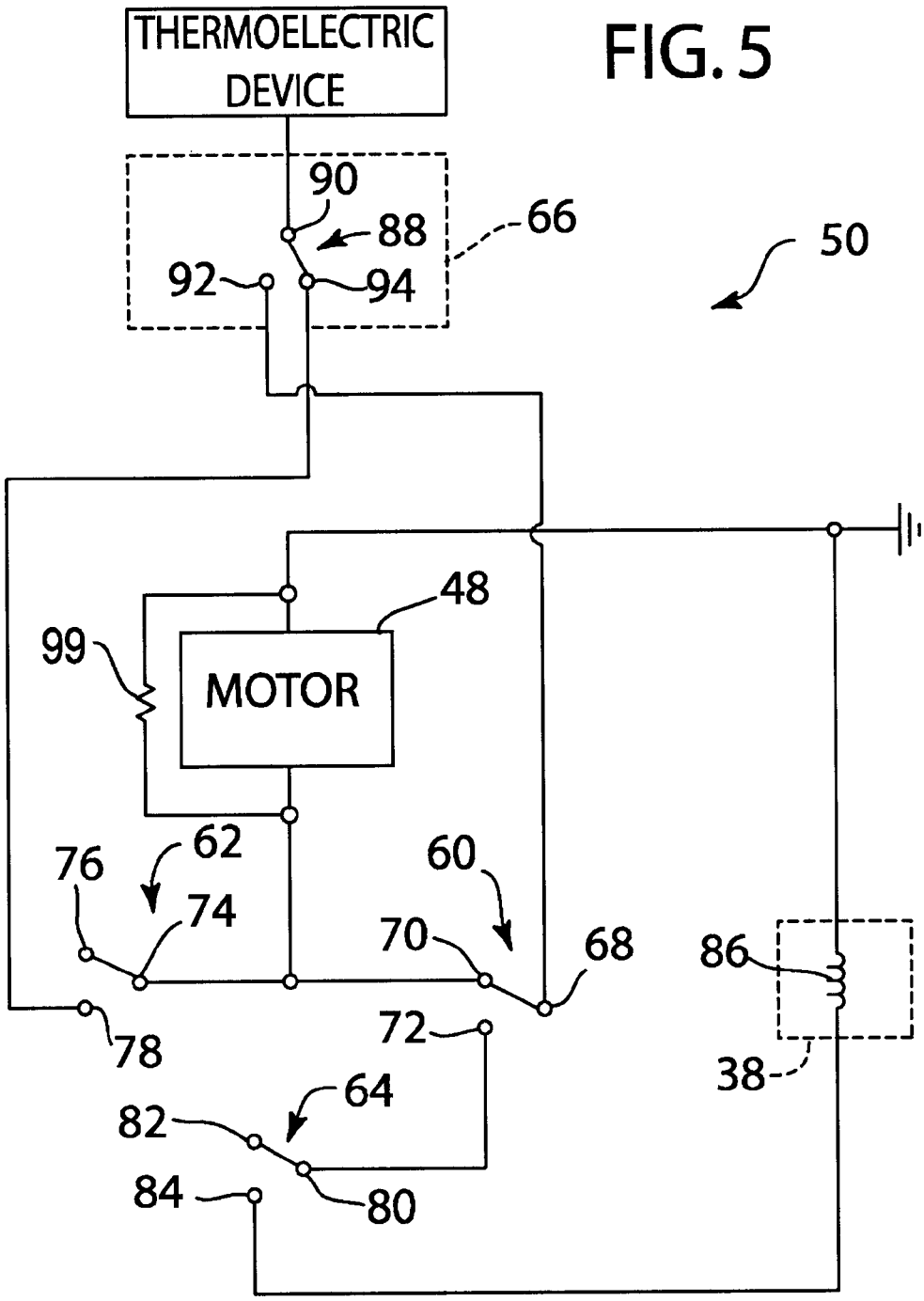
FIG. 5 is a schematic view illustrating a control circuit for a control device in accordance with a preferred embodiment as well as operation of the inventive control device.

Control device 12 is provided to control the operation of damper 32 and main burner valve 38 using the current generated by thermoelectric device 28. Referring to FIGS. 2 and 5, a control device 12 in accordance with the present invention may include a mounting plate 44, a printed circuit board 46, a motor 48, a control circuit 50, a cam 52. FIG. 5 shows the motor 48 with resistor 99 connected in parallel across motor terminals, producing dynamic braking as discussed in greater detail below.

Referring back to FIG. 2, mounting plate 44 provides support for several of the components of control device 12 and provides a means for mounting device 12 within appliance 10. Plate 44 may be made from a variety of conventional metals and plastics. Plate 44 may include an extension arm 54 that may be used to support a wire harness 56. Circuit board 46 provides a mounting surface for several of the components control circuit 50 and further provides conduction paths to direct current between motor 48 and control circuit 50.

Motor 48 is provided to move plate 40 and, in particular, to rotate plate 40 about axis 42, from a first position to a second position and from the second position to the first position. The first and second positions may correspond to a closed position of damper 32 and to an open position of damper 32, respectively. Motor 48 may comprise, for example a permanent magnet dc motor. Motor 48 may be mounted to mounting plate 44 and may further be connected to circuit board 46. Motor 48 includes a rotatable shaft 58 extending therefrom along axis 42 to which plate 40 of damper 32 is drivingly connected. Plate 40 may be directly connected to shaft 58 or may be indirectly connected to shaft 58 through, for example, a series of gears.

Control circuit 50 is provided to selectively transmit current to main burner valve 38 and to motor 48 to control the operation of main burner 24 and damper 32, respectively. Referring to FIG. 5, circuit 50 may comprise first, second, and third switches 60, 62, 64 and a temperature sensor 66. Switches 60, 62, 64 are provided to direct current to main burner valve 38 and motor 48 in order to operate main burner 24 and damper 32. Switches 60, 62, 64 preferably comprise single pole, double throw switches. Switch 60 comprises a common contact 68 coupled to temperature sensor 66, a first throw contact 70 coupled to motor 48, and a second throw contact 72. Switch 62 comprises a common contact 74 coupled to motor 48, a first throw contact 76, and a second throw contact 78 coupled to temperature sensor 66. Switch 64 comprises a common contact 80 coupled to second throw contact 72 of switch 60, a first throw contact 82, and a second throw contact 84 coupled to main burner valve 38. In particular, throw contact 84 may be coupled to a solenoid coil 86 of valve 38. Switches 60, 62, 64 may be mounted to circuit board 46. Each of switches 60, 62, 64 has a spring or other means for exerting a spring force within switches 60, 62, 64 to couple common contacts 68, 74, 80 of switches 60, 62, 64 and respective first throw contacts 70, 76, 82 of switches 60, 62, 64 in the absence of an intervening force.

Temperature sensor 66 is provided to measure the temperature of water, air, or another medium and to control the flow of current from thermoelectric device 28 responsive thereto. Sensor 66 may comprise a switch 88 that is responsive to a conventional thermostat or other appropriate temperature gauge for appliance 10. Switch 88 may comprise, for example a single pole double throw switch having a common contact 90 coupled to thermoelectric device 28, a first throw contact 92 coupled to common contact 68 of switch 60, and a second throw contact 94 coupled to second throw contact 78 of switch 62. Switch 88 may be mounted on circuit board 46. The temperature gauge used to control switch 88 may be located distant from circuit board 46 as appropriate for appliance 10 and may provide a signal indicative of the temperature of water, air or another medium through wire harness 56.

Figure 3:
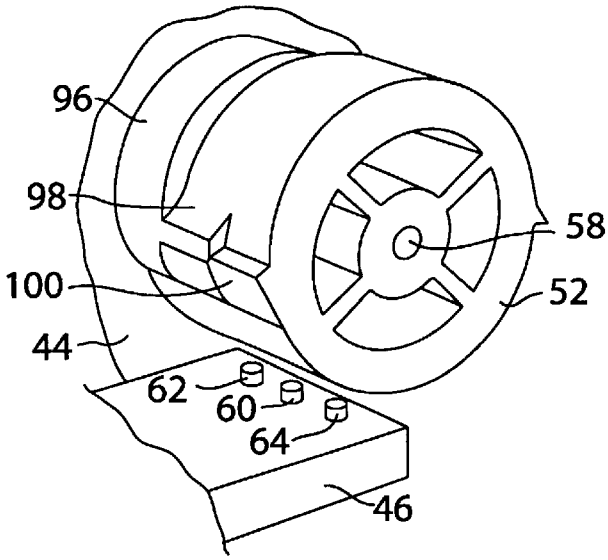
FIGS. 3–4 are perspective and plan views, respectively, of several of the components illustrated in FIG. 2.
Figure 4:
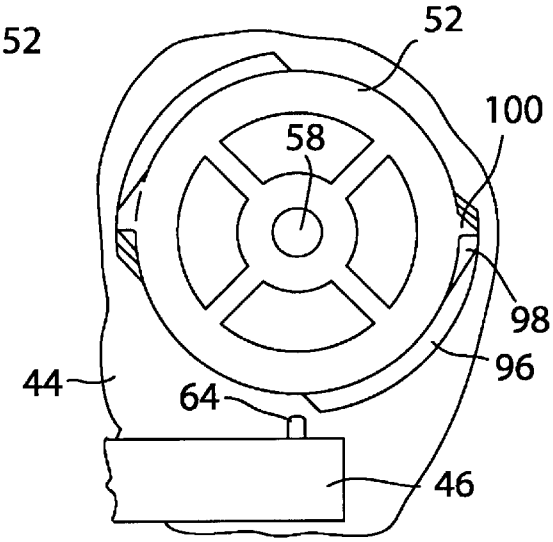

Referring to FIGS. 3 and 4, cam 52 is provided to overcome the spring force coupling common contacts 68, 74, 80 of switches 60, 62, 64 to respective first throw contacts 70, 76, 82 of switches 60, 62, 64 to thereby couple common contacts 68, 74, 80 with respective second throw contacts 72, 78, 84 of switches 60, 62, 64 as described in greater detail hereinbelow. Cam 52 may be coupled to shaft 58 for rotation therewith about axis 42 and may be mounted proximate to circuit board 46. Cam 52 comprises a first cam surface 96 configured to actuate switch 62, a second cam surface 98 configured to actuate switch 60, and a third cam surface 100 configured to actuate switch 64. Each of cam surfaces 96, 98,100 is divided into two identically-shaped angular sections disposed about the circumference of cam 52.

In operation, prior to a call for heat by temperature sensor 66, switches 60, 62, 64, 88 within control circuit 50 will assume the positions illustrated in FIG. 5. In particular, switch 88 of temperature sensor 66 assumes a state in which common contact 90 and second throw contact 94 are electrically connected. Each of switches 60, 62, 64 will assume a state in which their respective common contacts 68, 74, 80 are electrically connected to their respective first throw contacts 70, 76, 82. As a result, current will not be provided to either valve 38 or motor 48. When a temperature gauge within temperature sensor 66 detects that the temperature of the measured medium has fallen below a predetermined level, the switches will move and current will be provided to motor 48. The current will cause motor 48 to rotate shaft 58, and consequently, plate 40 of damper 32, from a first position to a second position. In particular, plate 40 will preferably rotate from a closed position to an open position in preparation for venting emissions of the combustion process.

Referring to FIG. 2, rotation of shaft 58 also causes rotation of cam 52. The cam 52 is configured so as to overcome the spring force within switches 60, 62, 64 and couple common contacts 68, 74, 80 of switches 60, 62, 64 to respective second throw contacts 72, 78, 84 of switches 60, 62, 64 once motor shaft 58, plate 40, and cam 52 reach a predetermined angular position—preferably corresponding to an open position for damper 32. Accordingly, as plate 40 of damper 32 rotates into an open position, cam 52, under normal operating conditions, forces each of switches 60, 62, 64 into a another switching state in which the respective common contacts 68, 74, 80 of switches 60, 62, 64 are coupled to the respective second throw contacts 72, 78, 84 of switches 60, 62, 64. As a result, once damper 32 has assumed the open position, current is directed from thermoelectric device 28 to main burner valve 38. Valve 38 is thereby opened and fuel gas is supplied to main burner 24 which is then ignited by pilot burner 22. Because damper 32 is in the open position, emissions from the combustion process are evacuated through vent 30. Once the temperature gauge in temperature sensor 66 determines that the measured medium has attained a predetermined temperature (i.e., the call for heat has been satisfied), switch 88 of temperature sensor 66 assumes a state in which common contact 90 is electrically connected to second throw contact 94. As a result, current is directed from thermoelectric device 28 to motor 48. The current causes motor 48 to rotate shaft 58, and consequently, plate 40 of damper 32, from the second position to the first position. In particular, plate 48 preferably rotates from the open position to the closed position in order to trap the heat remaining from the combustion process. Rotation of shaft 58 also causes rotation of cam 52. Cam 52 is configured such that, as shaft 58, plate 40, and cam 52 attain the first position, cam 52 allows the spring force of switches 60, 62, 64 to return switches 60, 62, 64 to a state in which common contacts 68, 74, 80 of switches 60, 62, 64 are electrically connected to respective first throw contacts 70, 76, 82 of switches 60, 62, 64. Accordingly, once motor shaft 58, plate 40, and cam 52 return to the first position, switches 60, 62, 64 will once again assume the positions set forth in FIG. 5.

In accordance with a highly advantageous feature, control device incorporates dynamic braking on motor 48. A DC motor can act as a generator while rotating, thus, cutting power to a DC motor will not cause it to stop right away. More specifically, the rotating motor acts as a circuit which is left open when the power is disconnected, so the only forces to cause a rotor of the motor to stop are windage, friction and hysteresis. Energy of rotation is dissipated using resistor 99 electrically connected to the motor in parallel (across motor terminals). Use of resistor 99 creates a circuit through which current can flow, and the energy is rapidly dissipated. This allows the DC motor 48 to stop faster than with an open circuit.

Figure 6:
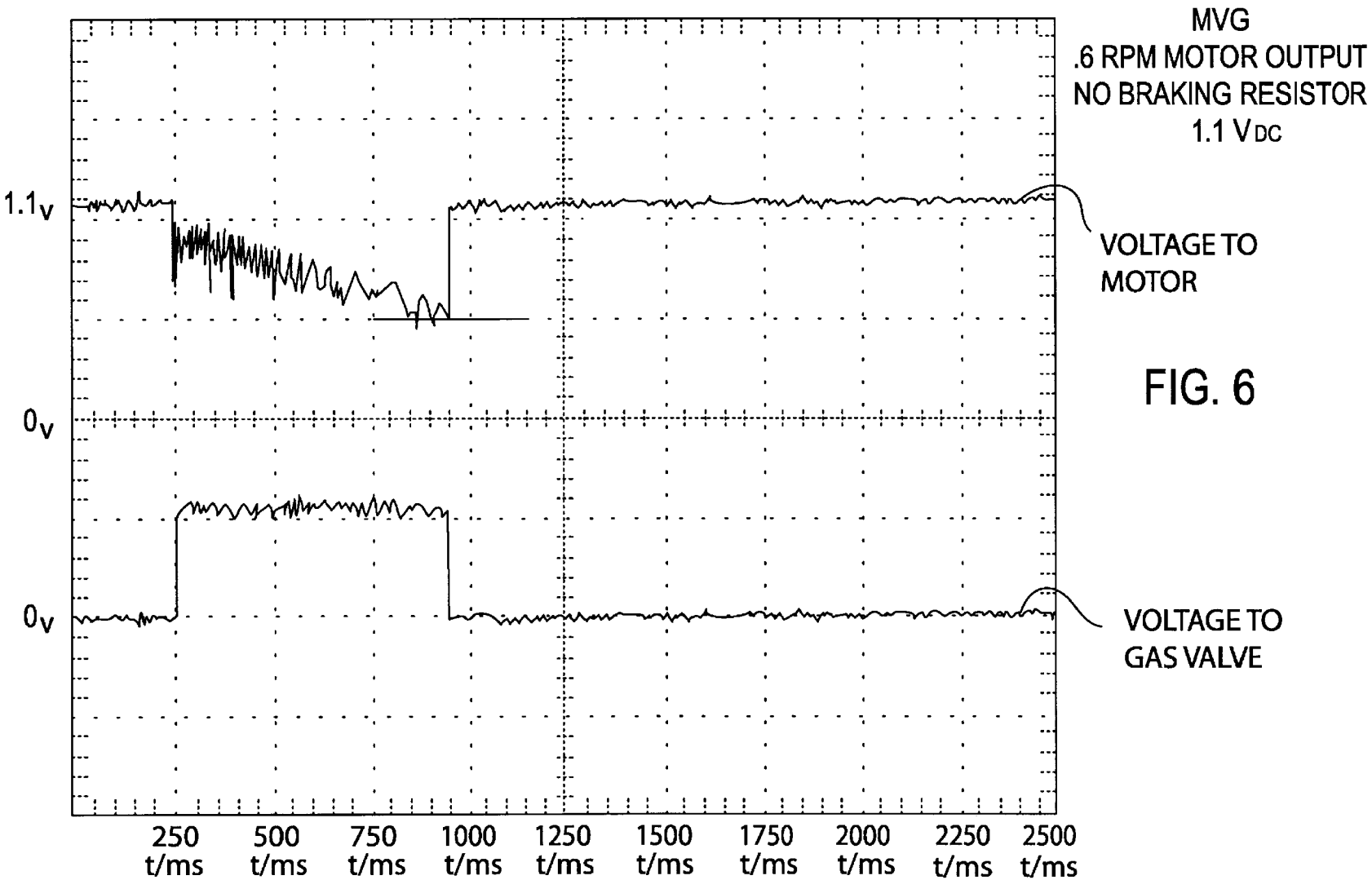
FIG. 6 shows a motor performance curve where voltages are applied which are higher than specified and "spinning" occurs.
Figure 7:
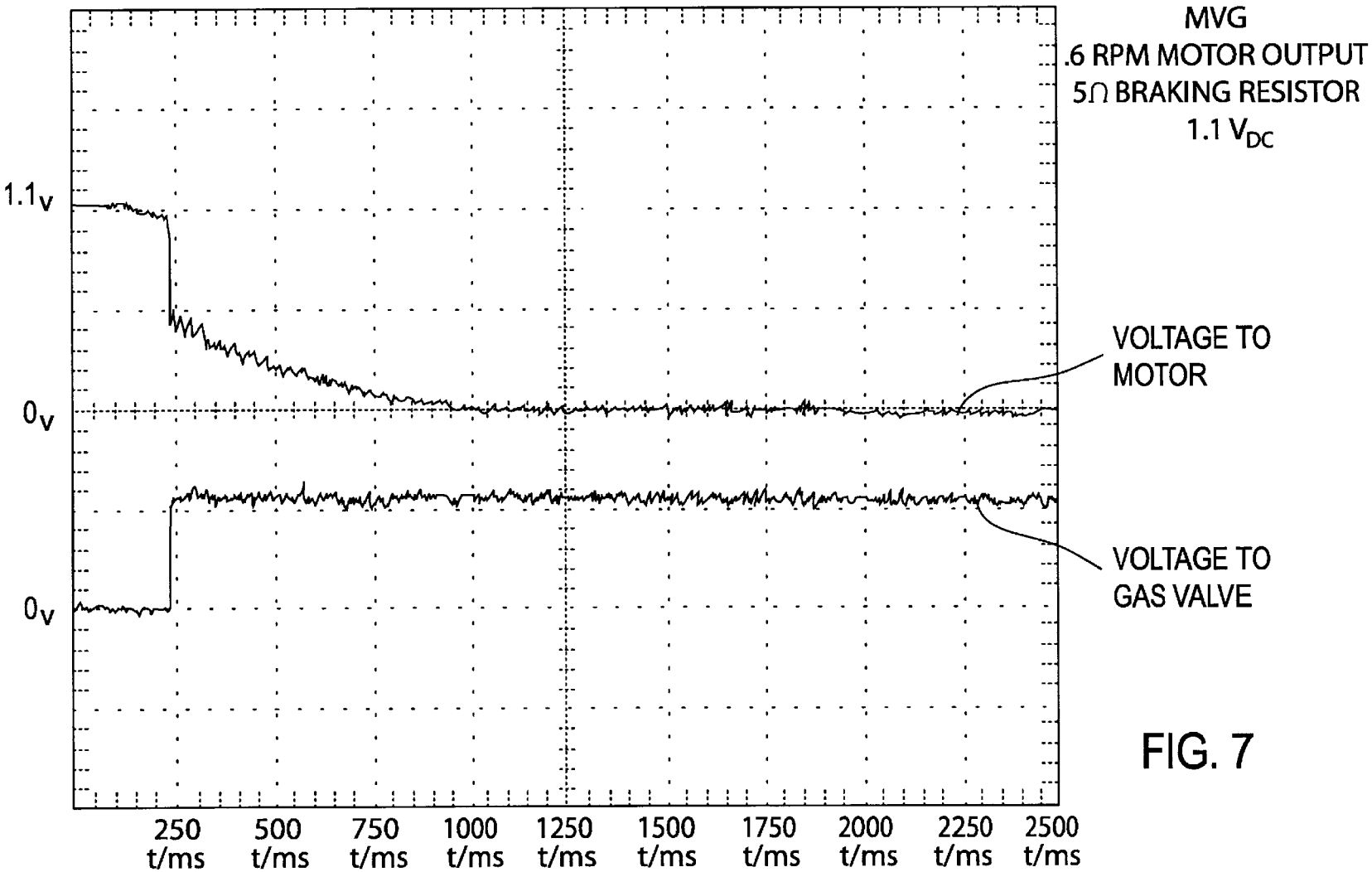
FIG. 7 shows a motor performance curve with the control circuit of a preferred embodiment of the present invention.

FIGS. 6 and 7 show representative example motor performance curves without dynamic braking (FIG. 6) and a preferred embodiment with dynamic braking (FIG. 7). In FIG. 6, top curve shows the voltage to the motor running at a significantly higher voltage (1.1 V) than a desired operating voltage of about 0.4 V. The bottom curve shows the voltage to the gas valve 38, which is the same as the voltage to the motor. When the appropriate switch is actuated by the cam 52, the voltage to the motor is removed and redirected to the gas valve 38. When the cam 52 rotates so as to depress the switch and cut off power to the motor 48, it can be seen that not all power is eliminated from the motor. This is due to the fact that a DC motor can act as a generator as noted above. Failure to eliminate power to the motor will cause continued motor rotation, which in turn will cause the damper to rotate to an undesired location and the cam to rotate back to the position corresponding to a request for power. This cycle can repeat, resulting in spinning of the damper.

FIG. 7 shows an example motor voltage graph where dynamic braking has been incorporated to rapidly cease rotation of the motor. A 5 Ohm resistor 99 is electrically connected as discussed above. As can be seen in the top curve, voltage across the motor has a large initial drop (from 1.1 V to about 0.5 V) that is nearly instantaneous and reaches zero within 0.75 seconds, and acceptable duration. Thus, advantageously, dynamic braking tolerates a wider range of operational voltages. Moreover, since high voltages can now be tolerated other components of the damper control may advantageously be optimized to work at lower voltages.

FIG. 7 shows a resistor with 5 Ohms performing acceptably with a motor designed to operate under millivolt applications. It will be readily apparent to those skilled in the art, given the benefit of this disclosure, that the optimum resistance will vary with the operational characteristics of the motor.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A device for controlling a damper in an appliance comprising, in combination:

a motor having a rotatable shaft extending therefrom operatively connected to a plate of the damper;

a control circuit for selectively transmitting current to the motor to rotate the shaft and in turn rotate the plate to a first position and to a second position; and a dynamic brake operatively connected to the motor to reduce rotation of the shaft when the current is removed from the motor.

2. The device of claim 1 wherein the dynamic brake is a resistor electrically connected in parallel with the motor.

3. The device of claim 1 wherein the motor has a normal operating voltage of 0.4 V and the resistor has a normal resistance of about 5 Ohms.

4. The device of claim 1 wherein the first position corresponds to a closed position of the damper and the second position corresponds to an open position of the damper.

5. The device of claim 1 wherein the appliance is gas-fired and has a pilot light, and a thermoelectric device supplies electric current to the motor.

6. The device of claim 5 wherein the control circuit comprises:

a temperature sensor;

a first switch having a common contact coupled to the temperature sensor, a first throw contact coupled to the motor and a second throw contact; and, a second switch having a common contact coupled to the motor, a first throw contact, and a second throw contact coupled to the temperature sensor.

7. The device of claim 6 wherein the temperature sensor comprises a third switch having a common contact coupled to the thermoelectric device, a first throw contact connected to the common contact of the first switch, and a second throw contact connected to the second throw contact of the second switch.

8. The device of claim 6, further comprising a cam coupled to the shaft for rotation therewith, the cam configured to couple the common contacts of the first and second switches with corresponding second throw contacts of the first and second switches when the plate of the damper is in the second position.

9. A device for controlling a damper in a gas-fired appliance comprising, in combination:

a motor;

a shaft rotatable by the motor and extending therefrom, wherein the shaft is operatively connected to a plate of the damper;

a cam coupled to the shaft for rotation therewith;

a control circuit for selectively transmitting current to the motor to rotate the shaft and in turn rotate cam, wherein rotation of the cam to a first position actuates at least one switch which removes current from the motor; and a dynamic brake operatively connected to the motor to reduce rotation of the shaft when the control circuit supplying current to the motor is opened.

10. The device of claim 9 wherein the dynamic brake is a resistor electrically connected in parallel with the motor.

11. The device of claim 9 wherein the motor operates on direct current.

12. A device for an appliance comprising, in combination:

a damper;

a motor having a rotatable shaft extending therefrom operatively connected to a plate of the damper;

a control circuit for selectively transmitting current to the motor to rotate the shaft and in turn rotate the plate to a first position and to a second position; and a resistor electrically connected in parallel to the motor, reducing rotation of the shaft when the current is removed from the motor.

13. The device of claim 12 wherein the motor has an energy of rotation and the resistor dissipates the energy of rotation of the motor.

* * * * *